US009032884B2

(12) United States Patent
Leen et al.

(10) Patent No.: US 9,032,884 B2
(45) Date of Patent: May 19, 2015

(54) PALLET

(75) Inventors: Richard Leen, Dessel (BE); Sander Mollet, Adegem (BE)

(73) Assignees: BVBA WALUTION, Sint-Niklaas (BE); SMO BVBA, Eeklo (BE)

( * ) Notice: Subject to any disclaimer, the term of this patent is extended or adjusted under 35 U.S.C. 154(b) by 0 days.

(21) Appl. No.: 14/119,113

(22) PCT Filed: May 15, 2012

(86) PCT No.: PCT/IB2012/000955

§ 371 (c)(1),
(2), (4) Date: Nov. 20, 2013

(87) PCT Pub. No.: WO2013/038241

PCT Pub. Date: Mar. 21, 2013

(65) Prior Publication Data

US 2014/0102339 A1 Apr. 17, 2014

(30) Foreign Application Priority Data

May 20, 2011 (BE) ..... 2011/0311

(51) Int. Cl.
*B65D 19/38* (2006.01)
*B65D 19/00* (2006.01)

(52) U.S. Cl.
CPC ..... *B65D 19/38* (2013.01); *B65D 19/0095* (2013.01); *B65D 2519/00029* (2013.01); *B65D 2519/00034* (2013.01); *B65D 2519/00064* (2013.01); *B65D 2519/00069* (2013.01); *B65D 2519/00094* (2013.01); *B65D 2519/00273* (2013.01); *B65D 2519/00293* (2013.01); *B65D 2519/00323* (2013.01); *B65D 2519/00333* (2013.01); *B65D 2519/00378* (2013.01); *B65D 2519/00567* (2013.01); *B65D 2519/00572* (2013.01); *B65D 2519/0099* (2013.01); *B65D 19/0004* (2013.01)

(58) Field of Classification Search
CPC ..... B65D 19/00; B65D 19/38; B65D 2519/00273
USPC ..... 108/56.1, 56.3, 57.14, 57.17, 57.2, 108/57.21, 57.23, 57.24, 57.33
See application file for complete search history.

(56) References Cited

U.S. PATENT DOCUMENTS

| | | | | | |
|---|---|---|---|---|---|
| 2,430,267 | A | * | 11/1947 | Arthur | 108/56.1 |
| 2,487,687 | A | * | 11/1949 | Arthur et al. | 108/57.14 |
| 2,652,219 | A | * | 9/1953 | Arthur | 108/57.14 |
| 2,916,240 | A | * | 12/1959 | Romero | 108/57.14 |
| 2,933,339 | A | * | 4/1960 | Alvden | 294/67.4 |
| 3,538,861 | A | * | 11/1970 | Jurasek | 108/57.14 |
| 3,835,791 | A | * | 9/1974 | Brown | 108/56.1 |
| 4,112,841 | A | * | 9/1978 | Deshpande | 101/141 |
| 4,230,651 | A | * | 10/1980 | Rao | 264/29.7 |
| 8,752,489 | B2 | * | 6/2014 | Linares | 108/53.1 |
| 2013/0118385 | A1 | * | 5/2013 | Ching | 108/57.14 |

* cited by examiner

*Primary Examiner* — Daniel Rohrhoff
(74) *Attorney, Agent, or Firm* — Symbus Law Group, LLC; Clifford D. Hyra

(57) ABSTRACT

A pallet having a top deck (1) and a frame (2) including one or more bottom slats (3) which extend, at a distance below the top deck (1), in which the bottom slat (3) is connected to the top deck (1) via an assembly of a wire-shaped connecting element (4) and a holder (5), (50) which are releasably connected to each other, and in which the connection between the connecting element (4) and the holder (5), (50) is designed to automatically come apart on account of a pulling force in order to prevent damage. The width of the wire-shaped connecting elements (4) is limited, as a result of which the pallet can be designed to have relatively short sides provided with lifting openings (6).

19 Claims, 6 Drawing Sheets

PALLET

This application claims the benefit of Belgian patent application No. 2011/0311, filed May 20, 2011, which is hereby incorporated by reference in its entirety.

FIELD OF THE INVENTION

The present invention relates to a pallet having a top deck and a supporting frame comprising one or more bottom slats which extend, at a distance from the top deck, underneath said top deck, with at least one bottom slat being connected to the top deck via an assembly of a connecting element and a holder which are releasably connected to one another.

Such pallets for storing and transporting goods are well-known, mainly in the distribution sector. Loading, unloading and moving goods stacked on a pallet can be carried out quickly and simply by moving the entire pallet by means of a moving lifting device such as a pallet truck or a forklift truck.

BACKGROUND

A known wooden pallet has a rectangular top deck, composed of wooden planks, and comprises a series of parallel deck planks which are attached to one another in such a way that the top side of these planks forms a relatively flat loading surface for the goods. This top deck is supported by a wooden frame which forms a sufficiently strong base and forms a stable support for the top deck at a certain height above the ground. To this end, said frame consists of a number of wooden blocks which are attached to the bottom side of the top deck and a number of bottom slats which are attached to the bottom side of these blocks and connect in each case two or more blocks with each other so that they form a bottom support surface.

Due to this construction, a space which is accessible via openings in the lateral sides of the frame is created underneath the top deck of a pallet. Said openings are delimited at the top by the top deck and are delimited laterally by said blocks. Via these openings, the lifting forks of a pallet truck or a forklift truck can be introduced into the space underneath the top deck from a side of the frame. By then moving these lifting forks upwards, the pallet can be lifted and subsequently readily be moved by displacing the lifting device.

The opening(s) provided on a lateral side of the pallet underneath the top deck via which the lifting forks of a lifting device can be moved underneath the top deck, are furthermore referred to in this patent application by the term 'lifting opening(s)'.

It is often found that the known pallets are damaged and that they are, in addition, damaged in such a way that they are unusable and difficult to repair. A relatively common cause of such damage is incorrect positioning of the forklift truck at the point in time when the lifting forks are moved upwards, as a result of which a bottom slat of the pallet is held back by the wheels or another part of the forklift truck while the lifting forks exert a lifting force on the top deck thereof. This is usually not noticed immediately by the operator of the forklift truck, and therefore the continuing upward movement of the lifting forks greatly damages the pallet. Sometimes, the goods stacked on the pallet are also damaged as a result thereof.

The pallets are placed in warehouses by means of forklift trucks. In this case, pallets are placed next to one another in rows with a very small clearance, so that the front side of these pallets is in each case a side which is provided with lifting openings for the forklift truck. For certain warehouse configurations, it is desirable to be able to accommodate more pallets per row, thus resulting in a desire for pallets having a smaller width than the existing pallets. However, the sides which are provided with lifting openings have to have a certain minimum length so that the dimensions and the position of the openings correspond to the standard position and the standard dimensions of the lifting forks of a lifting device.

SUMMARY

A first object of the present invention is to provide a pallet whose sides containing lifting openings can be shorter than those of existing pallets. A second object is to provide a pallet which is less easily damaged and rendered unusable. A third object of the present invention is to provide a strong, stable and user-friendly pallet which can be readily produced and which, in case of damage, can also be repaired more easily and quickly than the known pallets, at material and production costs which are similar to those of the existing pallets.

All these objects are achieved by providing a pallet with the features indicated in the first paragraph of the present description, in which, according to the present invention, the connecting element is wire-shaped and the connection between the connecting element and the holder is designed to automatically come apart on account of a pulling force exerted on the top deck and the frame.

As a result of using thread-like connecting elements, lifting openings can be delimited laterally by elements which take up very little space in the longitudinal direction of the respective pallet side. If two or more openings are provided in the same lateral side (e.g. one for each lifting fork), the width of the material situated between these openings is irrelevant for reducing the length of the respective pallet side. After all, the distance between the sides of the openings which are furthest apart and the width of these openings has to correspond to the width and the mutual position of the lifting forks and is therefore fixed. Only the width of the material which is situated on either side of the series of openings (i.e. between the first or last opening of the series and a corner of the pallet) has to be limited.

Wire-like elements made of materials such as, inter alia, metal, metal alloys, composite materials and the like, may already have sufficient strength and bending resistance with very limited transverse dimensions in order to render a pallet sufficiently strong and stable. Thus, a metal wire having a diameter of approximately 10 mm is already very suitable to be used for manufacturing a connecting element for a pallet according to the present invention.

As a result thereof, pallets can be produced in which a side with lifting openings is only slightly longer than the length which is required to provide lifting openings of the required dimensions and position in accordance with the standard dimensions and standard position of the lifting forks of a forklift truck and the like.

It is thus possible to produce pallets which, when placed in a warehouse, have a shorter front side and whose width therefore take up less space.

An additional advantage of the use of wire-shaped connecting elements is that such an element can be produced according to a relatively simple production method, for example, by automated folding of a continuous piece of wire-shaped material.

Yet another advantage of the use of wire-shaped connecting elements is that such a wire-shaped element is very suitable for producing a releasable connection which is released automatically on account of a pulling force, more specifically a click-fit connection.

In addition, the pallet according to the invention also has the advantage that the connection between the connecting element and the associated holder comes apart automatically on account of a pulling force. It goes without saying that the holder and the connecting element are best designed in such a manner that their connection only comes apart when a pulling force is exerted thereon which is greater than the force which can be exerted on the connected parts during normal use of the pallet. The connection between the bottom slat and the top deck is then released, as a result of which damage to the pallet is prevented.

For example, if the bottom slat is being retained by some kind of obstacle while the lifting forks push the top deck further upwards, a large pulling force will be exerted on the connected components, as a result of which said connection will come apart before the pallet is damaged.

In addition, the connection which has been pulled apart can also be restored relatively simply in situ, so that the pallet can immediately be made ready for use again. Should some damage be caused nevertheless, it will be less severe than is the case with known pallets. A damaged wire-shaped connecting element may, for example, be easy to replace. These connecting elements can be made available to the users as replacement parts.

In addition, the connection can also be designed as a click-fit connection so that the connection which has come apart can be readily restored in situ and without tools.

With this pallet, the holder is preferably formed by a trough-shaped element or a trough-shaped portion, in which the wire-shaped connecting element is releasably detained.

To this end, the pallet may be provided with a holder which is a trough-shaped element or comprises a trough-shaped portion, but the trough shape may also be formed between the opposite flanks of two different parts of the pallet, such as, for example, between the wall of a holder and the end side of a bottom slat connected to this holder.

Preferably, the connecting element and the trough-shaped portion are in this case designed such that a wire-shaped part of the connecting element can be releasably detained in the trough shape as a result of the fact that the trough shape itself is elastically deformable or the fact that a part which, in a first position, prevents the passage of the wire-shaped connecting element into the trough shape, is elastically deformable or can be moved, counter to a spring force, to a second position in which the wire-shaped connecting element can be placed in the trough shape and then returns to the first position.

With the pallet according to the present invention, therefore, preferably at least one bottom slat is connected to the top deck via at least one assembly of a wire-shaped connecting element and a holder, so that at least one lifting opening is formed underneath the top deck which is laterally delimited by at least one wire-shaped connecting element. In the case that two or more lifting openings are provided in the same lateral side, this means, as has been explained above, a lateral delimitation on one or both sides of the series of lifting openings and not delimitations situated between the openings.

In a preferred embodiment, at least one bottom slat is connected to the top deck at both ends via a respective assembly of a wire-shaped connecting element and a holder.

Preferably, the connecting element and the holder are designed in such a manner that they can be connected to each other by placing the connecting element and the holder against each other and pushing both towards each other using a connecting force. As a result thereof, the holder and the connecting element can readily be connected to one another again in situ and without tools.

In a preferred embodiment of the pallet according to the present invention, the holder comprises a deformable or displaceable retention means which can assume a coupling position and an uncoupling position in order to detain and release, respectively, the connecting element in the holder, and the retention means is designed, on account of said pulling force, to deform or be displaced as far as the uncoupling position, so that the connection between the connecting element and the holder is released.

The connecting element and the holder are therefore preferably also designed in such a manner that, when the connecting element and the holder are placed against each other and pushed towards each other using said connecting force, this results in the retention means being deformed or displaced as far as the uncoupling position, so that the connecting element is pushed into the holder, and, after the connecting element has been placed in the holder, in the retention means returning to the coupling position.

In a very preferred embodiment of this pallet, each wire-shaped connecting element comprises a base part which extends parallel to the upper surface of the top deck.

The holder may be attached to a bottom slat of the pallet, while the connecting element is connected to the upper part, or vice versa.

The holder then preferably comprises a trough-shaped portion in which said wire-shaped base part of the connecting element is releasably detained.

In a specific embodiment, the holder comprises a trough-shaped portion or the holder, together with another part of the pallet, delimits a trough-shaped space in which the wire-shaped base part of the connecting element is releasably detained.

However, the holder, together with an end side of the bottom slat, can also delimit a virtually trough-shaped portion in which the wire-shaped base part of the connecting element is releasably detained. In this arrangement, the holder is preferably connected to the bottom slat.

In a particular embodiment, the holder comprises, for example, a deformable lip which can assume a coupling position or an uncoupling position in order to detain or not detain, respectively, the connecting element in the holder, and this lip is designed to deform on account of said pulling force into the uncoupling position, so that the connection between the connecting element and the holder is released.

In a preferred embodiment, each wire-shaped connecting element also comprises an upper part which extends parallel to the upper surface of the top deck, and this upper part of each connecting element is connected to the top deck. In a specific embodiment, said upper part of the connecting element is accommodated in a duct or a bore in the top deck. Additionally, one or more fastening or retention means may be provided in order to prevent the upper part from being pulled out of this duct or this bore during normal use of the pallet.

In an alternative embodiment, the connection between the connecting element and the top deck can also be a releasable connection, in which case it may also be provided for this connection to come apart on account of a pulling force. Thus, deformable retention means may be provided to this end in the abovementioned duct or bore. More specifically, it may be provided for the connection to be achieved by pushing a portion of the connecting element into the duct or the bore, according to the principle of a click-fit connection.

In particular, the connecting element can in this case also be connected to a holder which is attached to the top deck and is releasably connected to the connecting element, in which case it may also be provided that the connection between the connecting element and the holder comes apart automatically on account of a pulling force. It may also be a click-fit connection which can be readily achieved without tools by pushing the connecting element and the holder together.

Each connecting element preferably also comprises a central part which extends in the vertical direction of the pallet. A wire-shaped element which extends in the vertical direction takes up the least space in the longitudinal direction of the respective pallet side (i.e. the side in which the lifting openings delimited by the connecting elements are provided).

In a very preferred embodiment, the connecting element is a single-piece wire-shaped element, comprising

- a U-shaped portion having two legs which extend next to each other in the vertical direction of the pallet and which, at the bottom, join a base part which extends parallel to the upper surface of the top deck and connects said legs to each other, and
- the bent upper end parts of said legs which extend parallel to said upper surface and next to each other in a direction which is at right angles to the direction of said base part.

Such a connecting element offers maximum strength and resistance to bending at minimal material and production costs.

The U-shaped portion of this connecting element then preferably extends in a plane which is at right angles to the longitudinal direction of the bottom slat, while the end parts of the connecting element extend according to the longitudinal direction of the bottom slat.

Thus, the U-shaped portion is at right angles to the longitudinal direction of the respective pallet side, as a result of which the space taken up by the connecting element in said longitudinal direction is minimal. The space which the connecting element takes up in said longitudinal direction then corresponds to the transverse dimension of the wire-shaped element (e.g. the diameter of the metal wire).

The connecting element preferably consists of a wire-shaped element made of metal or a metal alloy or a composite material, with inter alia steel of type S 235 (steel for machine structures with a minimum yield point of 235 $N/mm^2$) being preferred. For the sake of clarity, it should be noted that a wire-shaped connecting element according to the present invention can also be made from a wire-shaped material which is hollow. Thus, even a tubular element has to be considered as wire-shaped in the context of this patent application.

The top deck and the bottom slats of the pallet are preferably substantially made of wood or plastic. The top deck may have a continuous upper surface or may be provided with openings, depending on the area of use of the pallet.

In a very preferred embodiment, the pallet according to the present invention is substantially rectangular in shape, while the base slats run parallel to the short sides of the pallet, and while at least one base slat is connected to the top deck at both ends via a respective assembly of a wire-shaped connecting element and a holder, so that a lifting opening is formed between the top deck and the bottom slat which is delimited on both sides by a portion of the wire-shaped connecting element which extends between the base slat and the top deck.

Such a rectangular or square pallet may have a side whose length is at most approximately 60 cm, while the lifting opening between the top deck and the base slat is delimited on both sides by wire-shaped connecting elements, so that said lifting opening has a width of at least 55 cm.

The invention is now explained further by means of the following more detailed description of a possible embodiment of a pallet according to the present invention. The described embodiment is only an example and can therefore by no means be seen as a limitation of the scope of protection, nor of the area of application of the invention.

BRIEF DESCRIPTION OF THE DRAWINGS

In this detailed description, reference numerals are used to refer to the attached figures, in which.

DETAILED DESCRIPTION OF EMBODIMENTS

Figure 1:
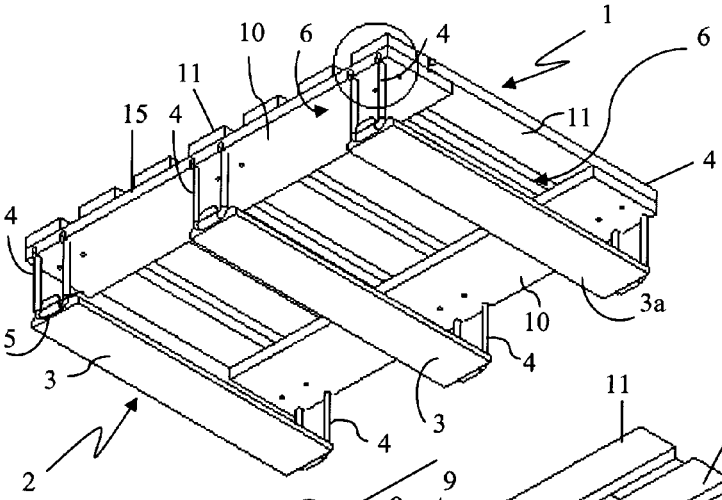
FIGS. 1 and 2 show a first embodiment of a pallet according to the present invention in perspective, viewed from the bottom side and from the top side thereof, respectively.
Figure 2:
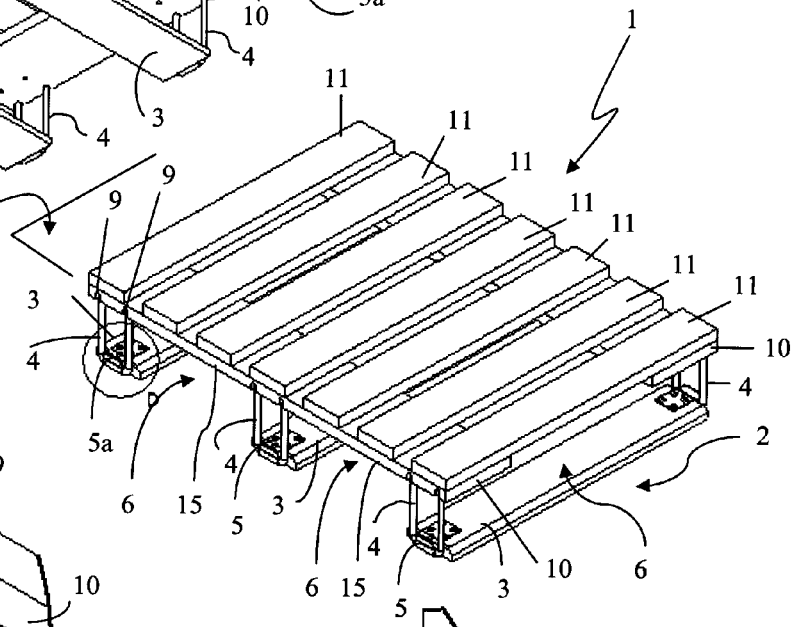

The pallet according to the present invention illustrated in FIGS. 1 and 2 comprises a rectangular top deck (1) which is composed of two intermediate wooden planks (10) which run parallel at an intermediate distance apart, so that the lateral edges thereof facing away from each other extend along the long sides of the pallet, and seven identical wooden deck planks (11) which are attached in parallel, at a small intermediate distance from each other, and with their longitudinal direction at right angles to the longitudinal direction of the intermediate planks (10), to the two intermediate planks (10). The sides of the first and the last deck plank (11) of the series which face away from each other define the short sides of the pallet. The deck planks (11) extend from one to the other long side of the pallet, up to the sides of the intermediate planks (10) which face away from each other. The top sides of the deck planks (11) are in an upper surface (A) and act as a loading surface for stacking goods.

This top deck (1) is supported by a frame (2) which is composed of three wooden bottom slats (3), each of which is connected to the top deck (1) via two assemblies of a connecting element (4) and a holder (5) which is connected to the latter. The edges of the bottom slats (3) extending in the longitudinal direction (L) are profiled, as can best be seen in FIG. 4.

The bottom slats (3) extend parallel to the deck planks (11) in the same direction. Two bottom slats (3) are situated underneath the first and the last deck plank (11), respectively, while the third bottom slat (3) extends centrally between the two other bottom slats (3), underneath the central deck plank (11).

Figure 4:
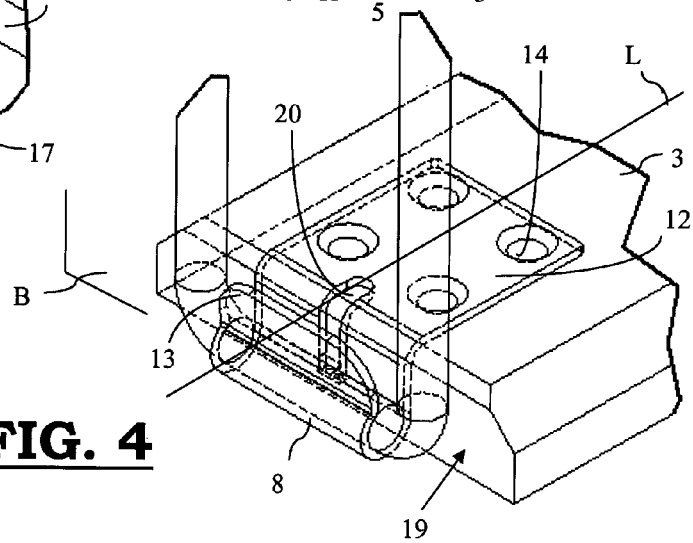
FIG. 4 shows an enlarged view of the part of the pallet which is circled in FIG. 2, in which the lower part of the connecting element which is detained in the holder, and a portion of a bottom slat can be seen.
Figure 8:
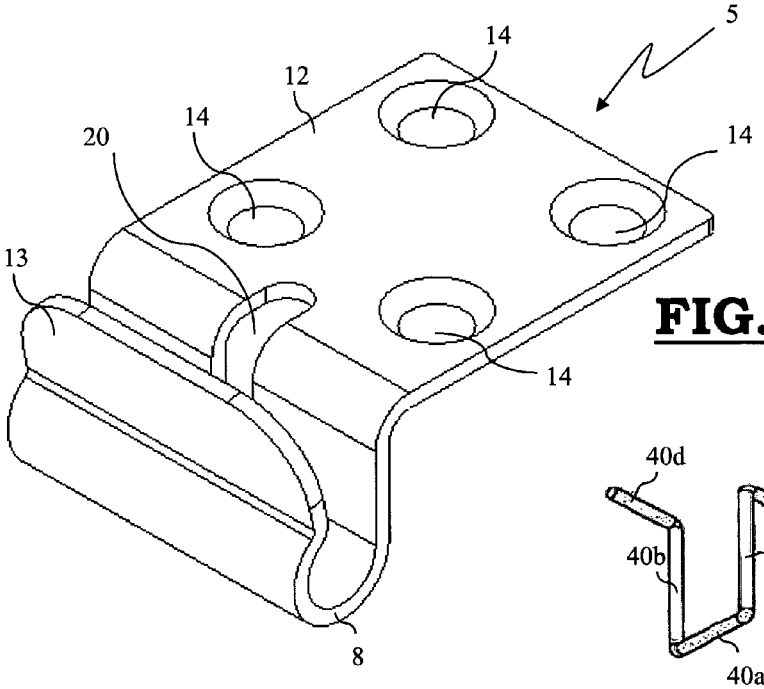
FIG. 8 shows the holder separately and in perspective.

Each bottom slat (3) is provided with a holder (5) at both ends, as is illustrated most clearly in FIG. 4. This holder (5) is made of metal and comprises (see also FIG. 8) a flat fastening platelet (12) which changes into a trough-shaped bent portion (8) which ends in a vertical edge portion (13).

Figure 5:
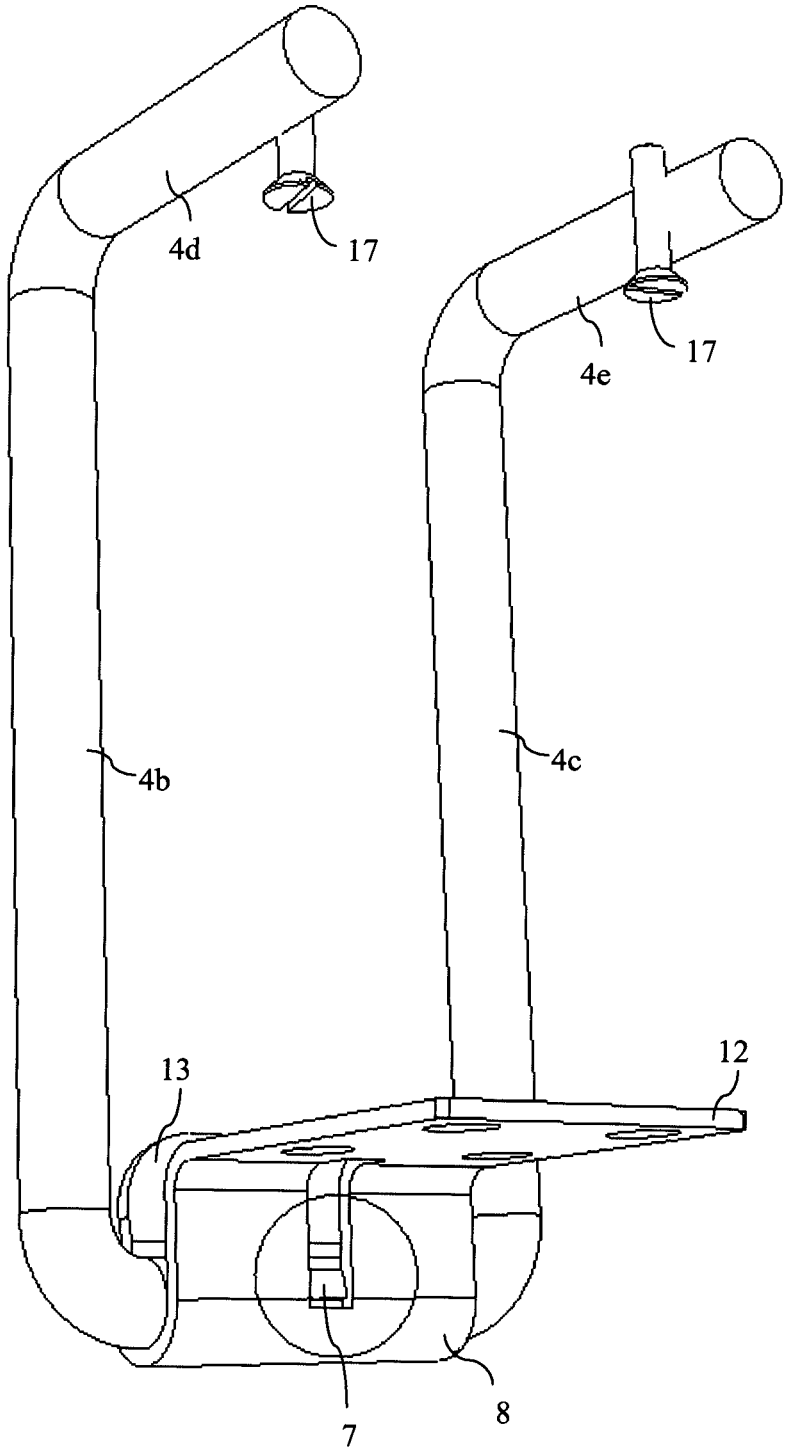
FIG. 5 shows an assembly of the connecting element and the holder connected thereto in perspective.
Figure 7:
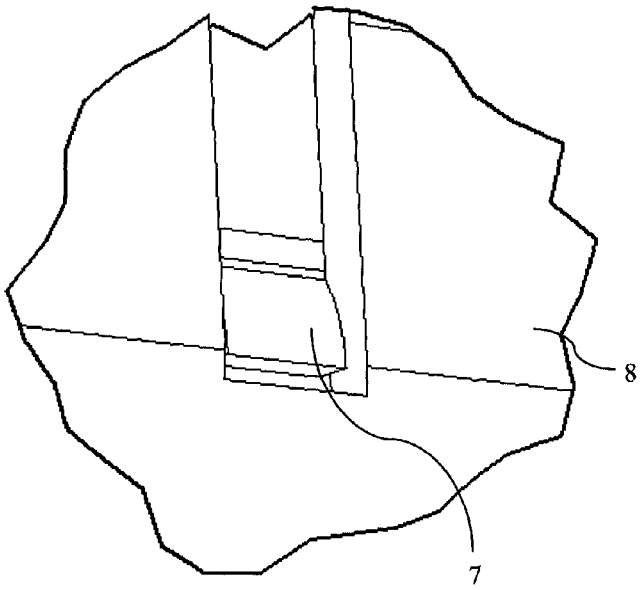
FIG. 7 shows an enlarged view of the portion of the holder which is circled in FIG. 5, in which in particular the deformable lip can be seen.

The fastening platelet (12) is provided with four screw openings (14). A cut-out (20) with a deformable lip (7) is provided (see FIGS. 5 and 7) in the wall of the trough-shaped portion (8) which faces the fastening platelet (12).

Such a holder (5) is attached at each end of the bottom slats (3). The fastening platelet (12) is positioned on the upper side of the bottom slat (3) and attached thereto by means of screws (not shown). The trough-shaped portion (8) is situated beyond the end side (19) of the bottom slat (3).

Figure 6:
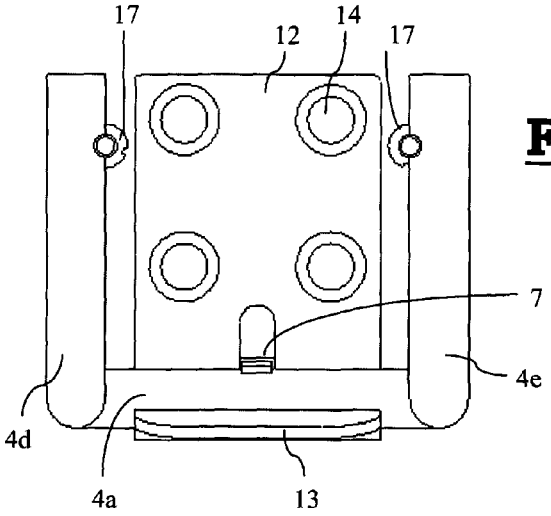
FIG. 6 shows a top view of the assembly illustrated in FIG. 5.

A wire-shaped connecting element (4) is connected to each holder (5). The connecting element (4) is made from a continuous metal wire (see FIGS. 5 and 6) and comprises a U-shaped portion with two legs (4*b*), (4*c*) which extend parallel to each other in the vertical direction of the pallet and which, at the bottom, join a base part (4*a*) which extends parallel to the upper surface (A) of the top deck (1) and connects said legs (4*b*), (4*c*) to each other.

The U-shaped portion of each connecting element (4) extends in a plane (B) which is at right angles to the longitudinal direction (L) of the bottom slat (3) which is connected thereto, while the end parts (4*d*), (4*e*) thereof extend along said longitudinal direction (L).

The base part (4*a*) is accommodated in the trough-shaped portion (8) of the holder (5) and is detained therein by the deformable lip (7). The walls of the trough-shaped portion (8) are also deformable, so that they exert an additional clamping force on the connecting element (4).

The upper end parts (4*d*), (4*e*) of these legs (4*b*), (4*c*) are bent so that they extend parallel to one another in a plane which is parallel to said upper surface (A) of the top deck, and run adjacent to each other in a direction which is at right angles to the direction of the base part (4*a*). These end parts (4*d*), (4*e*) are accommodated in corresponding bores (9) in the top deck (1). The bores (9) are provided above the ends of the bottom slats (3), in the lateral edges (15) of the two intermediate planks (10) which extend along the long pallet sides. At the location of each bore, cut-outs (16) are provided in these lateral edges (15), so that the opening of each bore (9) is recessed with respect to the vertical surface of the lateral edge (15). The result thereof is that the legs (4*b*), (4*c*) of the connecting elements (4) do not protrude beyond the long pallet edges, but are situated underneath the top deck (1).

Figure 3:
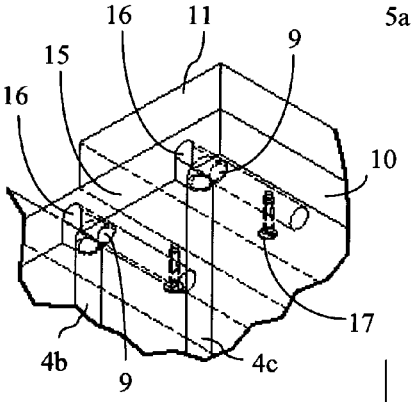
FIG. 3 shows an enlarged view of the part of the pallet which is circled in FIG. 1, in which the upper part of the connecting element with end parts which are accommodated in bores of the top deck and a portion of the top deck can be seen.

For each bore, a screw (17) is provided which extends into the bore (see FIG. 3) from the bottom side of the intermediate plank (10). The screw (17) extends in a cut-out in the end part (4*d*), (4*e*), thus ensuring mechanical locking of the end parts (4*d*), (4*e*) in the bores (9). After all, an end part (4*d*), (4*e*) cannot be pulled out of the bore (9) as long as the screw (17) is situated in the cut-out.

Figure 10:
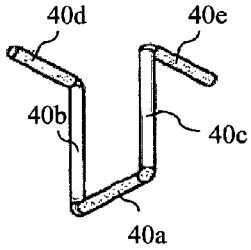
FIG. 10 shows a connecting element which is attached in the centre of a bottom slat of the pallet illustrated in FIG. 9.
Figure 9:
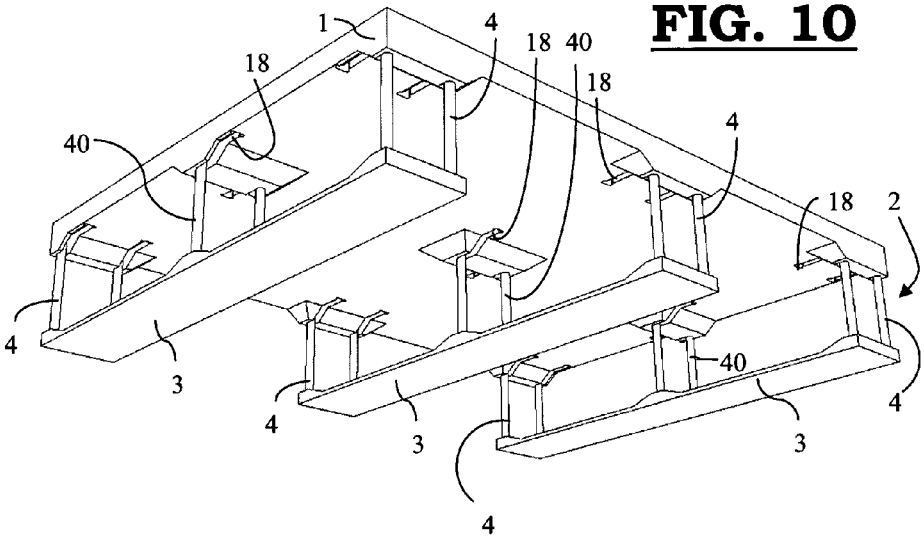
FIG. 9 shows a second embodiment of the pallet according to the present invention in perspective.
Figure 11:
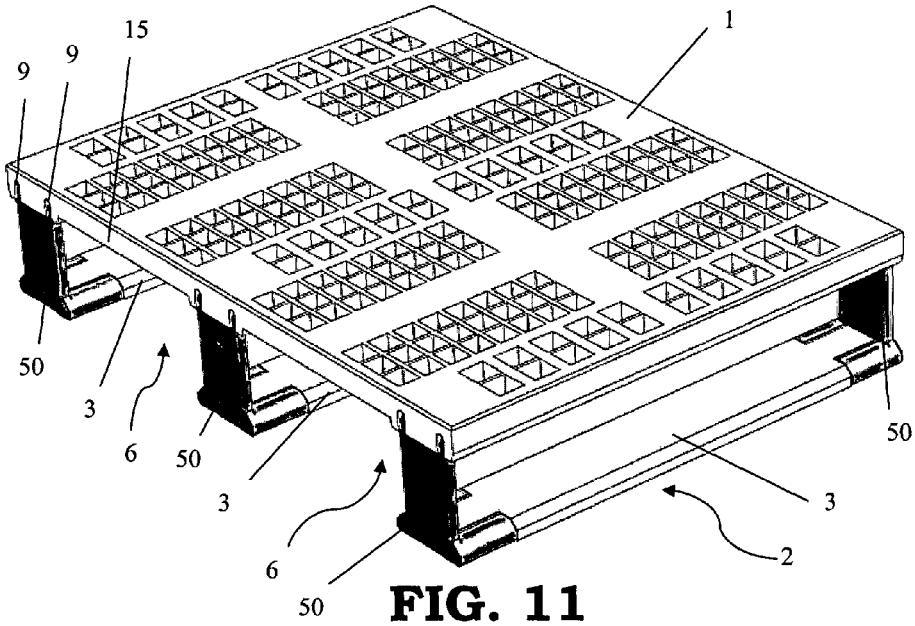
FIG. 11 shows a third embodiment of the pallet according to the present invention in perspective.
Figure 12:
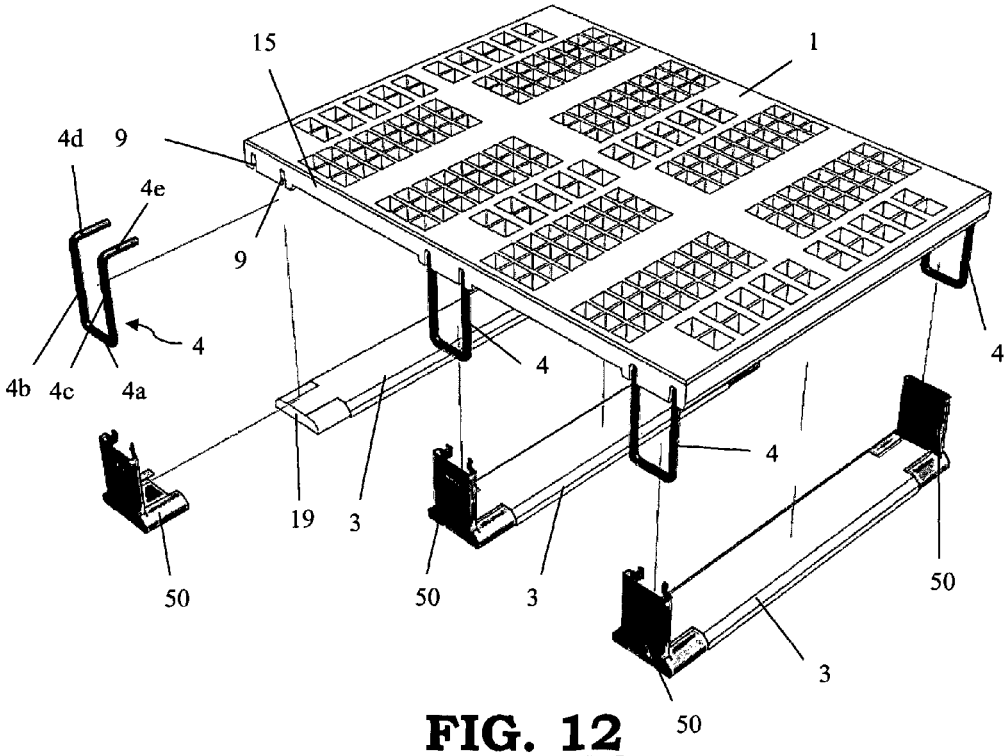
FIG. 12 shows a cut-away perspective view of the pallet illustrated in FIG. 11.
Figure 13:
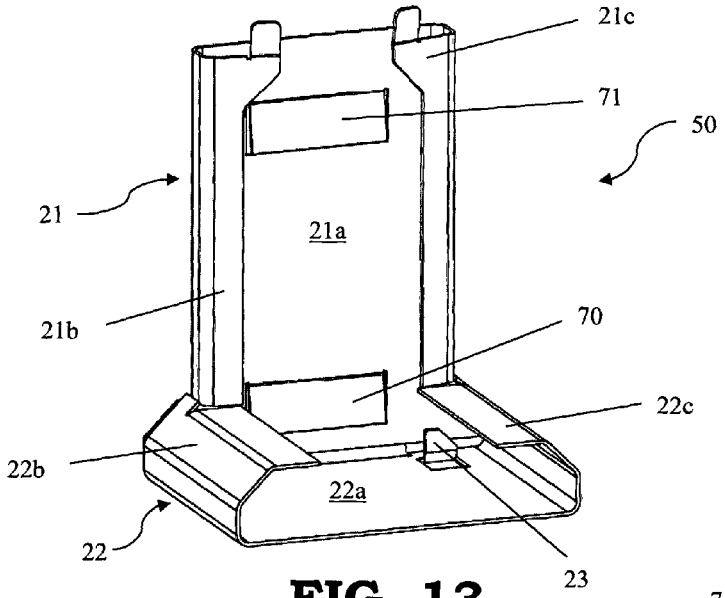
FIG. 13 shows a detail view of the holder from FIGS. 11 and 12.
Figure 14:
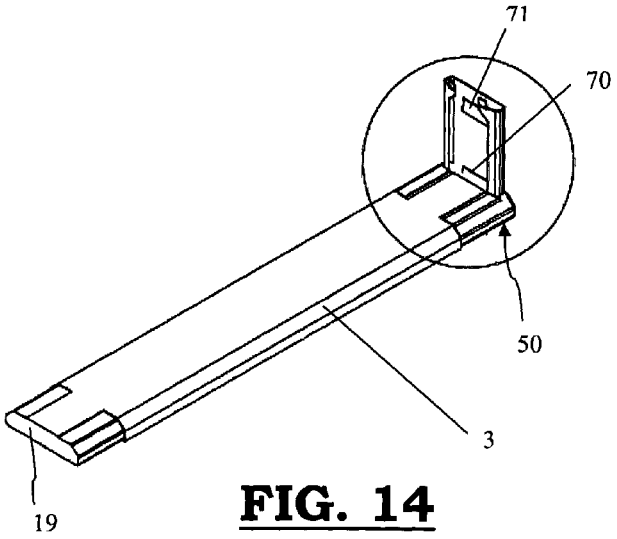
FIG. 14 shows an assembly of the holder and the bottom slat connected thereto according to the third embodiment.
Figure 15:
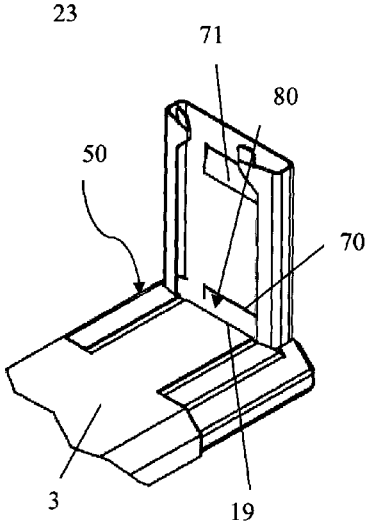
FIG. 15 shows an enlarged view of the part of the holder and the bottom slat which is circled in FIG. 14, in which in particular the trough-shaped portion can be seen which is delimited by the holder and the bottom slat.

A second possible embodiment of the pallet according to the present invention is illustrated in FIG. 9. It differs from the above-described pallet in that the top deck (1) does not comprise any openings and thus forms a continuous loading surface. Another difference is the fact that in this case two different types of connecting elements (4), (40) have been used. The connecting elements (4) on the ends of each bottom slat (3) are identical to the connecting element (4) which has been described above and illustrated in FIG. 5. The connecting elements (40) which have been attached in the centre of the bottom slats (3), have end parts (40*d*), (40*e*) which extend in the opposite direction, as illustrated in FIG. 10, and, for the remainder, are identical to the other connecting elements (4).

Both the connection between the connecting elements (4), (40) and the bottom slats (3), and the connection between the connecting elements (4), (40) and the top deck (1) are click-fit connections. Each connection is effected via a holder (5) which is releasably connected to the connecting element (1), but in this case this holder (5) is incorporated in the material of the top deck (1) and the bottom slat (3).

With the pallets according to the present invention, it is also possible for a simple opening or cut-out in the material of a pallet part (e.g. in the top deck or in a bottom slat) to fulfil the function of a holder (5). If this opening or cut-out makes it possible to produce a releasable connection with the connecting element and if the connection between the connecting element (4) and this holder (5) is designed to come apart automatically on account of a pulling force exerted on the top deck (1) and the frame (2), then this opening or cut-out also has to be regarded as a holder (5) in the sense which is given to it in the present patent application.

With this pallet, the end parts (4*d*), (4*e*) of the connecting element (4) are not accommodated in bores in the top deck (1), as is also the case with the above-described pallet, but are accommodated in corresponding elongate cut-outs (18) in the bottom side of the top deck (1). The connection to the bottom slats (3) is produced in the same manner.

A third possible embodiment is illustrated in FIGS. 11 to 15. It differs from the pallet according to the first embodiment in that use is made of an alternative holder (50). The bottom slats (3) are adapted to this alternative holder (50).

The connecting elements (4) are identical to the connecting element (4) described above and illustrated in FIG. 5 and, with this pallet, the end parts (4*d*), (4*e*) of the connecting element (4) are accommodated in bores (9) in the top deck (1), as is also the case with the pallet according to the first embodiment. At the location of each bore (9), cut-outs (16) are provided in the lateral edges (15) so that the opening of each bore (9) is recessed with respect to the vertical surface of the lateral edge (15).

The connection between the connecting elements (4) and the holders (50) are also releasable click-fit connections.

The holder (50) (see in particular FIG. 13) has a substantially L-shaped profile with a vertical part (21) and a horizontal part (22). Each part (21), (22) comprises a substantially closed wall (21*a*), (22*a*) and two parallel flanks (21*b*), (21*c*); (22*b*), (22*c*) having end parts which extend towards each other and extend opposite said wall (21*a*), (21*b*) at an intermediate distance, so that said wall and flanks of the vertical part (21) and the horizontal part (22) delimit a respective insertion space.

In the fitted state of the pallet, the legs (4*b*), (4*c*) running parallel in the vertical direction of the pallet and the base part (4*a*) of each connecting element (4) are situated in the insertion space of a vertical part (21) of a holder, and the end part of the bottom slat (3) is situated in the complementary insertion space of the horizontal part (22) of a respective holder (50).

However, it is not necessary for a portion of the bottom slat (3) to be pushed into an insertion space of the holder (50). The connection between the bottom slat (3) and the holder (50) can also be produced in another manner.

The bottom slat (3) which is in the horizontal insertion space has an end side (19) which is situated opposite and at a small intermediate distance from the closed wall (21*a*) of the vertical part (21). In this way, a trough-shaped portion (80) is formed between this end side (19) of the bottom slat (3) and the substantially closed wall (21*a*) of the vertical portion (21), in which trough-shaped portion (80) the base part (4*a*) of the connecting element (4) can be accommodated. Other embodiments in which a portion of the bottom slat (3) is not pushed in the holder (50), but in which the end side (19) does partially delimit the trough-shaped portion (80) are obviously also possible.

The connection between the connecting element (4) and the holder (50), in which a portion of the bottom slat (3) has been introduced, is achieved by pushing the connecting element (4) into the vertical part (21) until the base part (4*a*) thereof is situated above the trough-shaped portion (80). Then, the connecting element (4) is click-fitted into the trough-shaped portion (80) between the holder (50) and the end side (19) of the bottom slat (3) by means of a connecting force in such a manner that the base part (4*a*) is releasably detained in the trough-shaped portion (80). This click-fit connection is achieved by the fact that a deformable lip (70) is provided in the insertion space of the vertical portion (21). This lip (70) is formed on the substantially closed wall (21*a*) of this vertical part (21).

When the connecting element (4) is introduced in the insertion space, the base part (4*a*) first hits the upper portion of the deformable lip (70). By pushing the connecting element (4) and the holder (50) together by means of a connecting force, this force is transmitted to the lip (70), as a result of which the latter deforms until it reaches a position in which the connecting element (4) with its base part (4*a*) can be pushed beyond the lip (70) and reaches the trough-shaped portion (80). Subsequently, the lip (70) springs back into its non-deformed position.

When exerting a pulling force on the top deck (1) and the frame (2) which is connected thereto, the base part (4*a*) of the connecting element (4) will bear against the bottom edge of the deformable lip (70) and transmit this force onto the deformable lip (70), as a result of which this lip will deform until it reaches a position in which the base part (4*a*) can be displaced beyond the lip (70). As a result thereof, the connection between the connecting element (4) and the holder (50) is released.

In addition, a second deformable lip (71) is provided on the closed wall (21*a*) of the vertical part (21), above the former deformable lip (70). This lip (71) is also situated in said insertion space of the vertical part (21).

When the connection is pulled apart as a result of an incorrect operation, for example, by incorrect positioning of a forklift truck as described above, the pulling-apart movement will usually be stopped quickly, and the base part (4*a*) will not be pulled beyond the second lip (71). After the connection between the connecting element (4) and the holder (50) has been pulled apart, the bottom side of the connecting element (4) is consequently usually still situated in the insertion space, in a position in which the base part (4*a*) is situated in the zone between the first lip (70) and the second lip (71).

Once the pulling force is no longer exerted, the connecting element (4) still cannot leave the insertion space, because the base part (4*a*) is blocked by the second deformable lip (71).

Due to the fact that the wire-shaped connecting element (4) is therefore still in the insertion space and thus is not completely separated from the holder (50), the click-fit connection, and therefore the desired connection between the top deck (1) and the frame (2), can quickly be restored again. Thus, the weight of the goods stacked on the pallet may already exert a sufficiently large force to re-establish the connection.

However, if the top deck (1) and the frame (2) are moved apart still further and the pulling force continues after the base part (4*a*) has been moved out of the trough-shaped portion (80) and beyond the first lip (70), the second lip (71) is also deformed on account of this force, after which the connecting element (4) can leave the insertion space and be completely separated from the holder (50).

Due to the fact that the parallel legs (4*b*), (4*c*) of the connecting element (4*a*) are mounted in the vertical insertion space, it is simple to move the base part (4*a*) of the connecting element (4) in this insertion space back into its coupled position in the trough-shaped portion (80).

If the holder (50) and the connecting element (4) are connected to each other, the wall (21*a*) and the parallel flanks (21*b*), (21*c*) ensure that the parallel legs (4*b*), (4*c*) of the connecting element are held securely in place in the vertical insertion space. This assists the connection during normal use of the pallet. Due to the fact that the vertical portion (21) comprises a second deformable lip (71), the vertical insertion portion also partly ensures that the connecting element (4) is not completely separated from the holder (50) on account of a pulling force which is discontinued before the top deck and the frame are moved apart over a relatively large distance.

The insertion portion of the horizontal portion (22) of the holder (50) is delimited at the end which is situated opposite the wall (21*a*) of the vertical portion (21) by a vertical projection (23), in such a way that the bottom slat (3) cannot be inserted too far into the holder (50). After all, when the bottom slat (3) is pushed into the insertion space of the horizontal portion (21), the end side (19) of the bottom slat (3) will hit the projection (23), as a result of which any further movement is prevented.

This projection (23) ensures that a trough-shaped intermediate space (80) for accommodating the wire-shaped connecting element (4) is formed between the wall (21*a*) of the holder (50) and the end side (19) of the bottom slat (3).

The invention claimed is:

1. Pallet comprising a top deck and a supporting frame comprising one or more bottom slats which extend, at a distance from the top deck, underneath said top deck, with at least one bottom slat being connected to the top deck via an assembly of a wire-shaped connecting element and a holder which are releasably connected to one another, wherein the holder is formed by a trough-shaped element or a trough-shaped portion, in which the wire-shaped connecting element (4) is releasably detained and that the connection between the connecting element and the holder is designed to automatically come apart on account of a pulling force exerted on the top deck and the frame, wherein the holder comprises a deformable or displaceable retention device which can assume a coupling position and an uncoupling position in order to detain and release, respectively, the connecting element in the holder, and in that the retention device is designed, on account of said pulling force, to deform or be displaced as far as the uncoupling position, so that the connection between the connecting element and the holder is released.

2. Pallet according to claim 1, characterized in that the pallet comprises a trough-shaped portion which is formed between the opposite flanks of two different parts of the pallet.

3. Pallet according to claim 1, characterized in that at least one bottom slat is connected to the top deck via at least one assembly of a wire-shaped connecting element and a holder, so that a lifting opening is formed underneath the top deck which is laterally delimited by at least one wire-shaped connecting element.

4. Pallet according to claim 3, characterized in that at least one bottom slat is connected to the top deck at both ends via a respective assembly of a wire-shaped connecting element and a holder.

5. Pallet according to claim 1, characterized in that the connecting element and the holder are designed in such a manner that they can be connected to each other by placing the connecting element and the holder against each other and pushing both towards each other using a connecting force.

6. Pallet according to claim 5, characterized in that the connecting element and the holder are designed in such a manner that, when the connecting element and the holder are placed against each other and pushed towards each other using said connecting force, this results in the retention device being deformed or displaced as far as the uncoupling position, so that the connecting element is pushed in the holder, and in that, after the connecting element has been placed in the holder, in the retention device returning to the coupling position.

7. Pallet according to claim 1, characterized in that the holder comprises a deformable lip which can assume a coupling position or an uncoupling position in order to detain or not detain, respectively, the base part in the trough-shaped portion, and in that the lip is designed to deform on account of said pulling force into the uncoupling position, so that the connection between the connecting element and the holder is released.

8. Pallet according to claim 1, characterized in that each wire-shaped connecting element comprises a wire-shaped base part which extends parallel to the upper surface of the top deck.

9. Pallet according to claim 8, characterized in that the holder comprises a trough-shaped portion in which the wire-shaped base part of the connecting element is releasably detained.

10. Pallet according to claim 8, characterized in that at least one holder and an end side of a bottom slat connected to said holder together delimit an essentially trough-shaped portion in which the wire-shaped base part of the connecting element is releasably detained.

11. Pallet according to claim 1, characterized in that each wire-shaped connecting element comprises an upper part which extends parallel to the upper surface of the top deck, and in that the upper part of each connecting element is connected to the top deck.

12. Pallet according to claim 11, characterized in that the upper part of the connecting element is accommodated in a duct or a bore in the top deck.

13. Pallet according to claim 1, characterized in that each connecting element comprises a central part which extends in the vertical direction of the pallet.

14. Pallet according to claim 1, characterized in that the connecting element is a single-piece wire-shaped element, comprising a U-shaped portion having two legs which extend next to each other in the vertical direction of the pallet and which, at the bottom, join a base part which extends parallel to the upper surface of the top deck and connects said legs to each other, and bent upper end parts of said legs which extend parallel to said upper surface and next to each other in a direction which is at right angles to the direction of said base part.

15. Pallet according to claim 14, characterized in that the U-shaped portion of the connecting element extends in a plane which is at right angles to the longitudinal direction of the bottom slat, and in that the end parts of the connecting element extend according to said longitudinal direction.

16. Pallet according to claim 1, characterized in that the connecting element is made from metal wire.

17. Pallet according to claim 1, characterized in that it is a substantially rectangular pallet, the base slats of which run parallel to the short sides of the pallet, in that at least one base slat is connected to the top deck at both ends via a respective assembly of a wire-shaped connecting element and a holder, so that a lifting opening is formed between the top deck and the bottom slat which is delimited on both sides by a portion of the wire-shaped connecting element which extends between the base slat and the top deck.

18. Pallet according to claim 1, characterized in that it is a rectangular pallet having a side whose length is at most approximately 60 cm, in that a lifting opening provided on said side underneath the top deck is delimited on both sides by a respective wire-shaped connecting element, so that said lifting opening has a width of at least 55 cm.

19. Pallet according to claim 1, characterized in that the top deck and the bottom slats are substantially made of wood or plastic.

* * * * *